33-236 SR
12/13/77 OR 4,062,126

United States Patent [19]

O'Hara et al.

[11] 4,062,126

[45] Dec. 13, 1977

[54] DEADBAND ERROR REDUCTION IN TARGET SIGHT STABILIZATION

[75] Inventors: Peter J. O'Hara, Denville; Louis P. De Leo, Totowa Borough, both of N.J.

[73] Assignee: The United States of America as represented by the Secretary of the Army, Washington, D.C.

[21] Appl. No.: 739,395

[22] Filed: Nov. 8, 1976

[51] Int. Cl.[2] ..... F41G 3/00

[52] U.S. Cl. ..... 33/236; 33/321; 74/5.22

[58] Field of Search ..... 33/230, 236, 275 G, 33/318, 321, 322, 323; 74/5.22

[56] References Cited

U.S. PATENT DOCUMENTS

| | | | |
|---|---|---|---|
| Re. 23,303 | 12/1950 | Noxon | 33/236 |
| 2,752,684 | 7/1956 | Bentley et al. | 33/230 |
| 3,518,016 | 6/1970 | Burdin et al. | 33/318 |
| 3,713,335 | 1/1973 | Dupuis, Jr. | 33/321 |

FOREIGN PATENT DOCUMENTS

| | | | |
|---|---|---|---|
| 1,473,898 | 8/1969 | Germany | 74/5.22 |
| 1,925,326 | 11/1970 | Germany | 74/5.22 |

*Primary Examiner*—Richard E. Aegerter
*Assistant Examiner*—Richard R. Stearns
*Attorney, Agent, or Firm*—Peter A. Taucher; John E. McRae; Nathan Edelberg

[57] ABSTRACT

A mirror or other target-sight element in a military vehicle is subject to noticeable vibration or dislocation relative to inertial space as the vehicle moves over rough terrain. To prevent such vibration or dislocation the mirror is driven by a torque motor that is controlled by a gyroscope that mechanically senses these mirror dislocations. The demodulated gyroscope output signal is amplified and applied to the torque motor, which thereby makes the correct repositionment of the mirror to keep the reflected image in a generally stable position in spite of terrain disturbances. The present invention contemplates a second gyroscope also responsive to vehicle pitch movements. The demodulated output signal of this second gyroscope is applied to a zero cross over detector, which produces a square wave output signal substantially in phase with the signal from the first gyroscope. When the first signal approaches its mean level the square wave signal has already crossed over the mean level; therefore the square wave signal produces an abrupt flip-over of the motor control signal that aids in reversing motor movement. The square wave signal minimizes deadband hysteresis effects of motor friction during motor reversal periods and thereby aids in stabilizing the mirror image.

3 Claims, 2 Drawing Figures

DEADBAND ERROR REDUCTION IN TARGET SIGHT STABILIZATION

The invention described herein may be manufactured, used, and licensed by or for the Government for governmental purposes without payment to us of any royalty thereon.

BACKGROUND AND SUMMARY OF THE INVENTION

In military tanks the gunner and commander each view the target zone through individual mirrors that are swingably mounted within the hull or turret. The gunner or commander adjusts his mirror by actuating controllers for the voltage supply to a torque motor that is drivingly connected to the mirror pivot shaft. At times the torque motor also receives a voltage signal from a gyroscope that responds to vibrational dislocations of the mirror due to terrain disturbances, principally pitching movements about the transverse axis of the vehicle. At such times the torque motor applies a torque to the mirror to keep it reasonably stable in spite of the terrain disturbances.

Under some conditions the torque motor may be unable to keep pace with the mirror dislocation movements. The mirror therefore jiggles or vibrates in spite of the attempted corrections by the motor. The principal reason for this undesirable condition is motor friction and system inertia that oppose rapid reversal of the motor and associated gearing.

The present invention proposes a second gyroscope responsive to terrain disturbances for generating a second motor control signal. This second signal is passed into a zero crossover detector, which produces a square wave output substantially in phase with the main gyro signal. An algebraic summing amplifier combines the two signals into a useful motor control signal that provides increased motor energizer voltage of opposite polarity when the motor is required to reverse its movement direction. The aim is to minimize deadband effects due to motor friction and system inertia.

THE DRAWINGS

Figure 1:
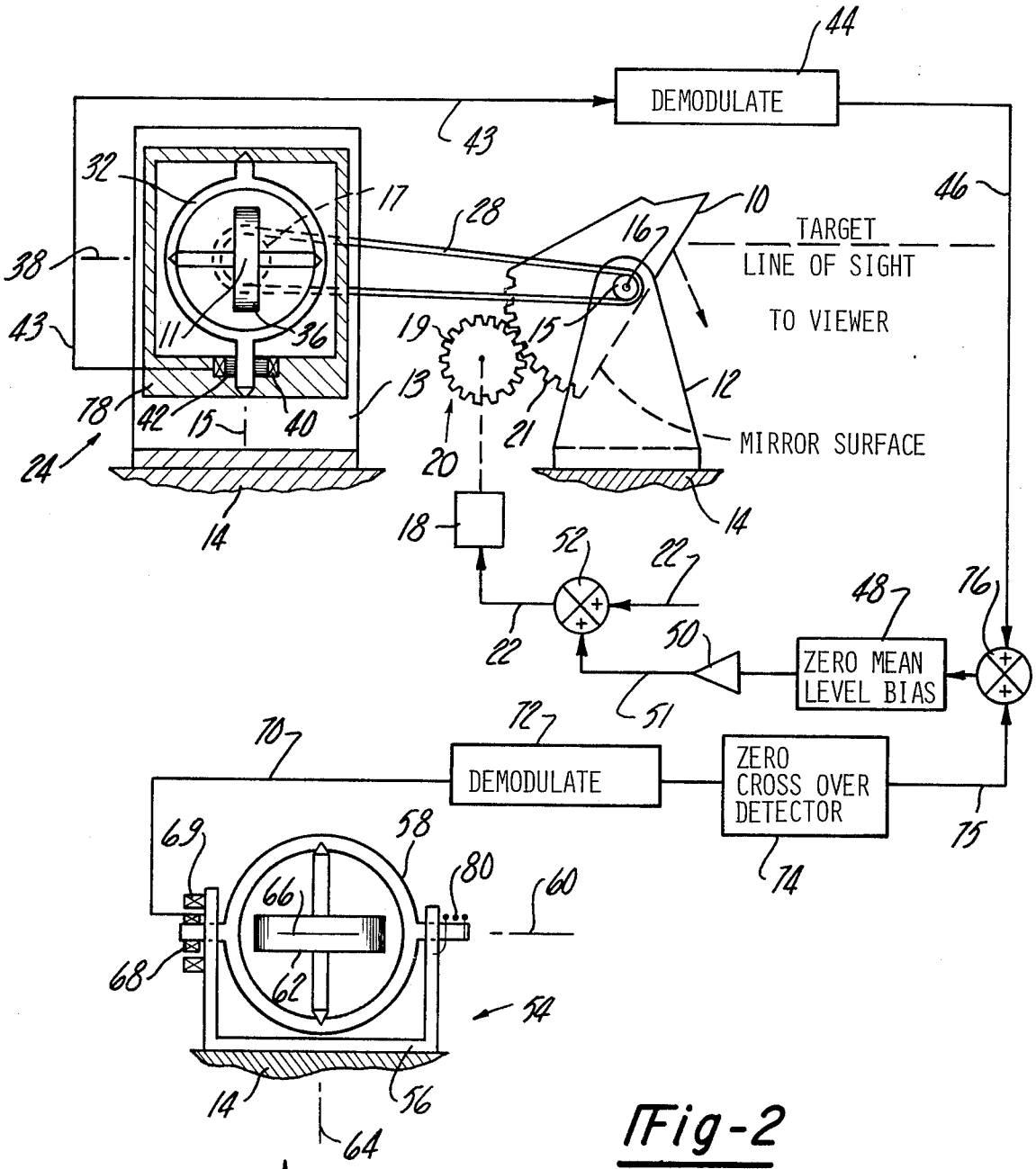

FIG. 1 schematically illustrates a mirror control system embodying the invention.

Figure 2:
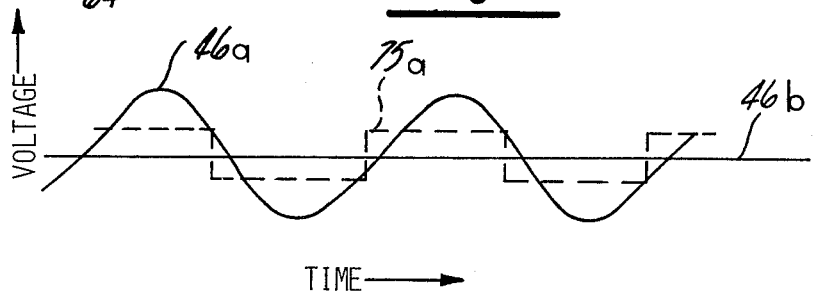

FIG. 2 illustrates two voltage signals generated during operation of the FIG. 1 system.

GENERAL SYSTEM DESCRIPTION

The illustrated system comprises a mirror target sight element 10 swingably mounted in a yoke 12 carried by part 14 of the hull of a military ground vehicle, such as a tank. The swing mount for the mirror comprises a shaft 16 that extends through bearings (not shown) in yoke 12. The mirror would usually be arranged in the hull or turret of the vehicle, with shaft 16 on a horizontal axis extending generally transverse to the direction of the vehicle movement or gun aim direction. The commander or gunner would thus be enabled to adjust the mirror about the shaft 16 axis in accordance with elevational changes of the target. Mirror adjustment is accomplished by a torque motor 18 and speed reducer 20, shown schematically as a small diameter gear 19 driven by motor 18 and a larger diameter sector gear 21 carried by mirror 10. The variable voltage supply line for the motor is indicated by numeral 22; a summation amplifier 52 is interposed in line 22 for a purpose hereinafter described. Manual controller means (not shown) at the gunner or commander station would be used to adjust the polarity and magnitude of the line 22 voltage, and hence mirror 10 movement. Motor 18 is reversible according to reversals in polarity of the supply voltage.

During movement of the vehicle over rough terrain the terrain disturbances tend to produce undesired reciprocatory dislocations of mirror 10 relative to inertial space. The commander or gunner, as the case may be, therefore has difficulty in keeping the target in clear view. The jiggling mirror movement tends to blur the view. Under conventional practice motor 18 is energized to oppose the jiggling mirror movement, thus tending to keep the mirror reasonably stable in spite of the terrain disturbances.

The necessary motor-energizer signal is generated by a two frame rate gyroscope 24 that mechanically responds to mirror dislocations in inertial space via drive band 28 and the hull. The schematically illustrated gyroscope comprises an outer frame or platform 78 having a rotational suspension axis 11 on a yoke 13 carried by hull part 14. Stub shafts (not shown) project outwardly from frame 78 along axis 11 into bearings on yoke 13 to provide the suspension action. One of the stub shafts carries a wheel or gear 17 that has a belt 28 trained thereon; the belt also runs over a wheel or gear 15 carried by mirror shaft 16.

Disposed within frame 78 is an inner frame 32 having a rotational movement axis 15 perpendicular to axis 11. A conventional rotor 36 is rotatably arranged within frame 32 for spinning movement around a horizontal axis 38 extending transverse to aforementioned axis 11 and parallel to the vehicle roll axis.

The rotor is continuously driven at high rotational speed around axis 38, for example twenty thousand revolutions per minute, by suitable field structure (not shown). The conventional pick-off means includes a rotor 42 carried by frame 32 and an inductance coil 40 carried by frame 78. A suitable A.C. voltage, e.g. 26 volts at 400 cycles per second, produces a varying amplitude signal in output line 43. The signal is demodulated at 44 to produce a D.C. signal in line 46 that is in synchronism with the movements of mirror 10 and gyro platform 78 relative to inertial space.

When the mirror is vibrating the belt 28 produces a deflection of frame 78 around suspension axis 11. The gyroscopic action causes rotor 36 to maintain a vertical spin plane. Therefore the rotor causes frame 32 to turn around axis 15, thereby causing the line 46 signal voltage to vary in magnitude as indicated by curve **46*a* in FIG. 2; when the gyro platform 78 and mirror 10 are stabilized the line 46 voltage will have a constant value as indicated by straight line "mean level" curve 46*b***.

The mirror is mechanically coupled from its shaft 16 to gyro platform 78 by a ratio of 1:2 (by selection of the pulley diameters). This comes about because the angle of incidence and angle of reflection at the mirror surface are additive in an optical error sense. A given angular pitch change of platform 78 by a terrain disturbance produces an angular change in the image direction (off mirror 10) that is equal to the platform 78 change. Corrective repositionment of the mirror by motor 18 requires that the mirror movement be ½ the angular movement of platform 78 by belt 28. Motor 18 is energized by a circuit initiated or controlled by the line 46 signal.

The line 46 signal is passed into a summing amplifier 76 that receives a second input from line 75. The output from amplifier 76 is applied to a conventional zero mean level bias means 48 for conversion to an A.C. signal having positive and negative polarities. The A.C. signal is then amplified at 50 and fed through line 51 to a summing amplifier 52 that also receives the primary control signal from the aforementioned manual controller. The amplifier 52 output is delivered to motor 18 so that the motor is caused to apply an error-correcting torque input to mirror 10. Motor 18 changes the mirror position as required to keep the target in view, and also stabilizes the mirror against vibrational dislocations due to terrain disturbances.

THE PRESENT INVENTION

The present invention adds to the above-described system a second gyroscope 54 that generates a voltage related to pitching movements of the vehicle. As shown, the gyroscope comprises an outer upright frame 56 mounted on vehicle part 14, and an inner frame 58 rotationally movable within frame 56 around horizontal axis 60. A spinning rotor 62 is disposed within frame 58 for high speed rotation around a vertical axis 64.

During operation when the hull of the tank experiences pitch movements about its transverse axis, the gyroscopic action of the gyro rotor 62 causes a precession of frame 58 around axis 60 relative to frame 56; this generates an A.C. voltage in pick-off inductance coil 68 that is electromagnetically linked to voltage supply coil 69 carried by frame 56. Coils 40 and 69 are preferably energized from a common voltage source so that the varying amplitude signal in line 70 has the same frequency and phase as the line 43 signal voltage.

The high frequency signal in line 70 is demodulated at 72 to produce a time-variant signal that may be similar in magnitude and phase to the line 46 signal. The time-variant signal is passed into a zero-crossover detector 74, which has a square wave output, designated by curve **75*a* in FIG. 2. Detector 74 may be a conventional device, for example that shown generally by U.S. Pat. No. 3,766,411 issued on Oct. 16, 1973 to R. D. Arnold or U.S. Pat. No. 3,895,237 issued on July 15, 1975 to J. D. Harr. The present invention proposes the use of a conventional crossover detector to produce a square wave output substantially in phase with the line 46 signal. The two signals are fed through lines 75 and 46 to a conventional summing amplifier 76** which produces an output that is the algebraic sum of the two input signals.

As seen in FIG. 2 the straight line curve **46*b* represents a condition of no correcting torque input by motor 18 to the gyro platform and hence the mirror. For example, when the vehicle is on smooth terrain and the gyro platform 78 experiences no reciprocatory vibration, the signals in lines 43 and 70 are of constant amplitude; the demodulated signals in lines 46 and 75 produce a voltage signal represented by line 46*b* (FIG. 2). The output voltage from summation junction 76 retains a straight line character; when a suitable biasing voltage is applied at 48 to such a signal the resultant signal in line 51** is extinguished or non-existent.

Gyroscopes 24 and 54 produce time-variant demodulated signals **46*a* and 75*a* when the terrain induces pitch motions in the mirror and hull, respectively. The output from summation junction 76 then provides an A.C. signal in line 51 that enables motor 18 to reversibly move back and forth in a fashion to stabilize the gyro platform 78 and hence the mirror position. During most parts of each cycle the square wave signal 75*a* is additive to the primary control signal 46*a*. However at those times in the cycle when signal 46*a* is approaching the mean level line 46*b* the square wave signal is already on the opposite side of the mean level line; therefore the square wave signal is then subtractive. As signal 46*a* crosses the mean level value the square wave signal furnishes a voltage for energizing motor 18 in the opposite direction; i.e. opposite polarity. In effect the square wave signal 75*a*** anticipates the requirement for motor reversal voltage, and thereby minimizes deadbands due to drive train friction and inertia.

Each of the gyros 24 and 54 is preferably a rate gyro, as opposed to a displacement gyro. The rate gyro output is related to the angular pitch velocity in space, whereas displacement gyro output is related to the angular pitch displacement in space. In general it is believed that the rate gyro produces a more useful signal than the displacement gyro in this invention environment. A rate gyro requires a spring or other biasing means opposing the force or torque that is causing the precession. In the drawings numeral 80 references suitable biasing spring means; the showing is schematic, since in practice the gyroscope structure would be dictated by the gyroscope manufacturer. Suitable rate gyroscopes are available from such companies as Kearfott Division of the Singer Company.

The theory of this invention can be applied to other servo control systems using sensors other than gyroscopes. For example, systems using tachometer type sensors might utilize zero crossover detectors and summation amplifiers to develop an "anticipating" opposite polarity motor control signal.

We wish it to be understood that we do not desire to be limited to the exact details of construction shown and described for obvious modifications will occur to a person skilled in the art.

We claim:

1. A sight element stabilization system for a military ground vehicle designed to traverse rough terrain comprising a vehicle-mounted sight element mounted for pivotal movement about a generally horizontal axis and subject to reciprocatory dislocation about said axis by the terrain disturbances; a reversible torque motor drivingly connected to the sight element to minimize the reciprocatory dislocations; and control means for the motor; said control means comprising a first gyroscope mechanically connected to said sight element for generating a first time-variant signal related to the terrain-generated dislocation of the sight element, a second gyroscope positioned within the vehicle to respond to the same terrain disturbances that produce reciprocatory dislocations of the sight element, said second gyroscope being constructed to generate a second time-variant signal related to the terrain-generated dislocation of the vehicle, a zero crossover detector converting the second signal into a square wave signal, and signal summation means combining the first signal and square wave signal into a motor control signal for driving said torque motor.

2. In the system of claim 1: said zero crossover detector being effective to cause the square wave signal and first signal to be on opposite sides of the signal mean level when the first signal approaches the mean level.

3. In the system of claim 1: said first and second signals being substantially in phase, whereby the square wave signal and first signal are additive.

* * * * *